United States Patent [19]

Grossman

[11] Patent Number: 5,000,230

[45] Date of Patent: Mar. 19, 1991

[54] LOOM SLEY MOVEMENT WITH A TOGGLE JOINT

[75] Inventor: Hans Grossman, Heidenheim, Fed. Rep. of Germany

[73] Assignee: Hermann Wangner GmpH & Co., United Kingdom

[21] Appl. No.: 465,661

[22] Filed: Jan. 16, 1990

Related U.S. Application Data

[63] Continuation of Ser. No. 288,164, Dec. 22, 1988, abandoned.

[30] Foreign Application Priority Data

Dec. 22, 1987 [IT] Italy ..... 3743661

[51] Int. Cl.[5] ..... D03D 49/64

[52] U.S. Cl. ..... 139/190

[58] Field of Search ..... 139/188 R, 189, 190, 139/191

[56] References Cited

U.S. PATENT DOCUMENTS 2,159,865 5/1936 Shimwell et al. ..... 139/190

3,858,621 1/1975 Dvoracek et al. ..... 139/190

FOREIGN PATENT DOCUMENTS 2208881 9/1973 Fed. Rep. of Germany ..... 139/190

2520015 7/1983 France ..... 139/190

*Primary Examiner*—Andrew M. Falik

[57] ABSTRACT

A sley drive for a large power loom is comprised of a toggle joint moved by a complementary cam drive and linked on the one hand to the machine frame and on the other hand to the sley support. The toggle joint is folded when the reed beats against the fabric. In order to save space, the complementary cam drive and the toggle joint are arranged below the sley support, and the toggle joint engages the sley support below its pivot point. The arm of the toggle joint linked to the sley support is designed to be foldable about an intermediate pivot point and the pivot point is guided along a cam. The cam is adapted to be turned away from quick shutdown and a shock absorber is moved into engagement with the arm at the point where the toggle point is linked to the sley support.

4 Claims, 4 Drawing Sheets

LOOM SLEY MOVEMENT WITH A TOGGLE JOINT

This is a continuation of application No. 07/288,164 filed Dec. 22, 1988.

BACKGROUND OF THE INVENTION

The invention relates to a sley drive for a power loom and more specifically to a sley drive having a cam driven toggle joint connected between a main frame and the sley support.

In the sley drive described in German Application DE-A No. 2 101 720, the toggle joint is in an outstretched position when the reed beats against the fabric and the toggle joint is linked to the sley support above the pivot point thereof. Due to this arrangement, the complementary cam drive must be provided alongside the sley.

In German Patent DE-C No. 302 114, a shut-down mechanism for a power loom is disclosed where the sley is driven by a foldable crank shaft. The crank shaft is caused to fold by an elbow subject to spring pressure. The pivot point is disposed slightly below the crank shaft center line so that the crank shaft is stable when under pressure. However, it cannot be subjected to tension since the crank shaft would stretch somewhat so that the pivot point and the two end points of the crank shaft would be disposed on one line and the crank lever would be in an unstable position. Therefore, the return motion of the sley in the known shut-down mechanism is effected by the proper weight of the sley. Since for shut-down the pivot point of the crank shaft moves against the elbow, the loom can only be shut down when the sley is moving.

In textile power looms the sley is normally driven directly by way of a crank or other cam drive. In heavier power looms for making technical fabrics, e.g. papermachine fabrics, greater beating force of the reed is required and therefore, the sley is driven in most cases by way of a toggle joint which is driven, in turn, by an eccentric or complementary cam drive. In such a mechanism, the toggle joint is operated in a restrained manner.

SUMMARY OF THE INVENTION

The present invention has the object of improving a sley drive of the generic type so that the production speed is increased. This is accomplished by having the toggle joint folded when the reed beats against the fabric. Since the toggle joint is folded when the reed beats against the fabric, the pivot point of the sley support can be positioned close to the sley so that with a length of travel of about 80 mm, for example, of the beating point, the substantial mass of the sley only needs to move 63 mm.

A further reduction of the mass to be moved is achieved by the arrangement according to the present invention since by locating the complementary cam drive and the toggle joints below the sley, the height of the sley support can be reduced to less than half. At the same time, the space required by the sley drive is reduced.

The present invention also provides a new and improved mechanism for the quick shut-down of the sley drive. At the same time an arm of the toggle joint linked to the sley support reciprocates in response to pressure and tension. Since a cam which guides the reciprocating arm can be turned away regardless of movement of the sley, quick shut-down is possible even when the sley is at a standstill.

The complementary cam drive is operated by the man shaft of the power loom. While in a conventional power loom for making papermachine fabrics from chemical threads, the sley support has a typical length of 1.3 m, the pivot point is positioned at the lower end and the reed moves along an arc having a length of 270 mm, in a comparable sley drive according to the invention a sley support having a length of about 0.5 m is sufficient. The upper frame portion of the reed moves along a circular arc having a radius of 255 mm. The toggle joint is connected a distance of 255 mm below the pivot point. The upper frame portion of the reed, like the pivot point between sley support and toggle joint, moves along a circular arc having a length of 91 mm. The center of gravity of the sley positioned nearer the pivot point moves along a circular arc of 63 mm length. Due to the shorter length of the sley support not only is the mass to be moved smaller, but the reed travels a shorter path. Both contribute to an increase in the operating speed of the power loom.

DETAILED DESCRIPTION OF THE INVENTION

Figure 1:
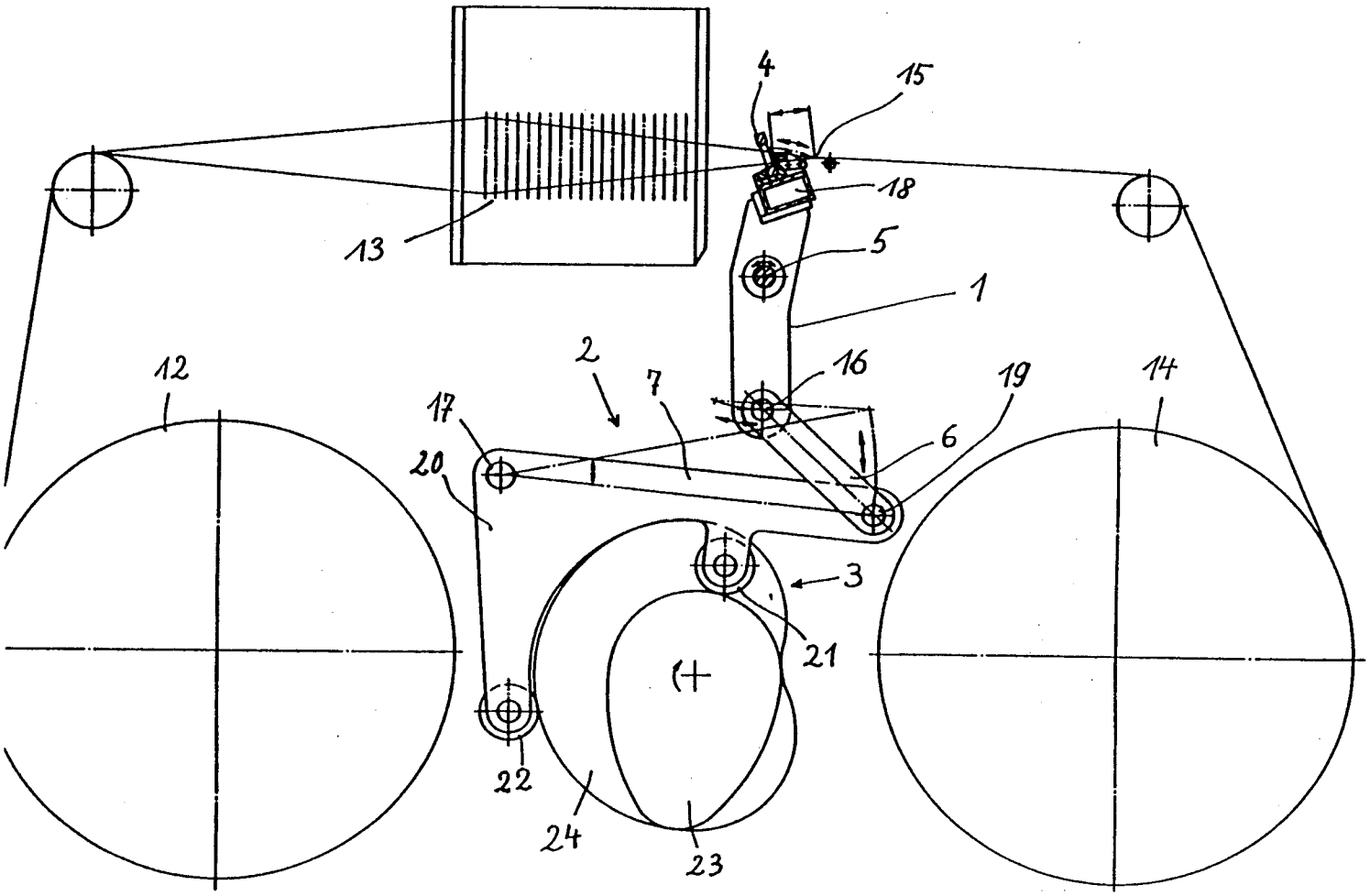
FIG. 1 is a schematic side elevation view of the sley drive along the weft direction.

FIG. 1 only shows portions of a power loom including the warp beam 12, the heald frames 13, the cloth beam 14, the sley 18 with a sley support 1 and the drive means for the sley support. The sley drive comprises a toggle joint 2 and a complementary cam drive 3. The sley 18 carries at its upper end the reed 4. The sley support 1 is rotatable about a pivot pin 5 which is located in about the middle of the sley support 1.

The toggle joint 2 has a first arm 6 linked to the lower end of the sley support 1 at pivot point 16 and a second arm 7 driven by the complementary cam drive 3. The first arm 6 is only about half as long as the second arm 7, and the toggle joint 2 is so designed that at the moment the reed 4 beats against the fabric at stop point 15, it is nearly completely folded so that the two arms 6, 7 extend nearly in parallel and the toggle joint 2 can develop maximum force. As the sley 18 performs its return motion the toggle joint 2 opens to the extent that the two arms 6, 7 enclose an angle of about 30°.

The second arm 7 of the toggle joint 2 extends substantially horizontally and is so arranged that its pivot point 17, where it is secured to the machine frame, is offset to one side below the sley support 1, while the connecting point 19 of the two arms 6, 7 is offset to the other side below the sley support 1. Suitably the drive 3 is designed as a two fold roller guide with two complementary cams. To this end, the second arm 7 has a portion 20 extending at an angle of about 90° away from the pivot point 17. A roller 21 is provided in the second arm 7 and a roller 22 is provided on the portion 20. The rollers 21 and 22 follow different cams 23, 24 which are mutually complementary, i.e. the two cams 23, 24 have such configurations that at all times both rollers 21, 22 engage the associated curves of cams 23 and 24, respectively, and the second arm 7 is thereby positively guided along its predetermined path. The configuration of the cams 23, 24 and the cooperation thereof with the two rollers 21, 22 need not be described in more detail, as such twofold roller guide systems with complementary cams are generally known.

In the example illustrated by FIG. 1 the reed 4 engages with its upper frame portion. The admissible beating force of the reed 4 is not as strong as a beating motion with the lower frame portion. However, it has been found that in the manufacture of sheet forming fabrics from synthetic resin threads the beating force is sufficient when the upper frame portion performs the beating motion.

Figure 2:
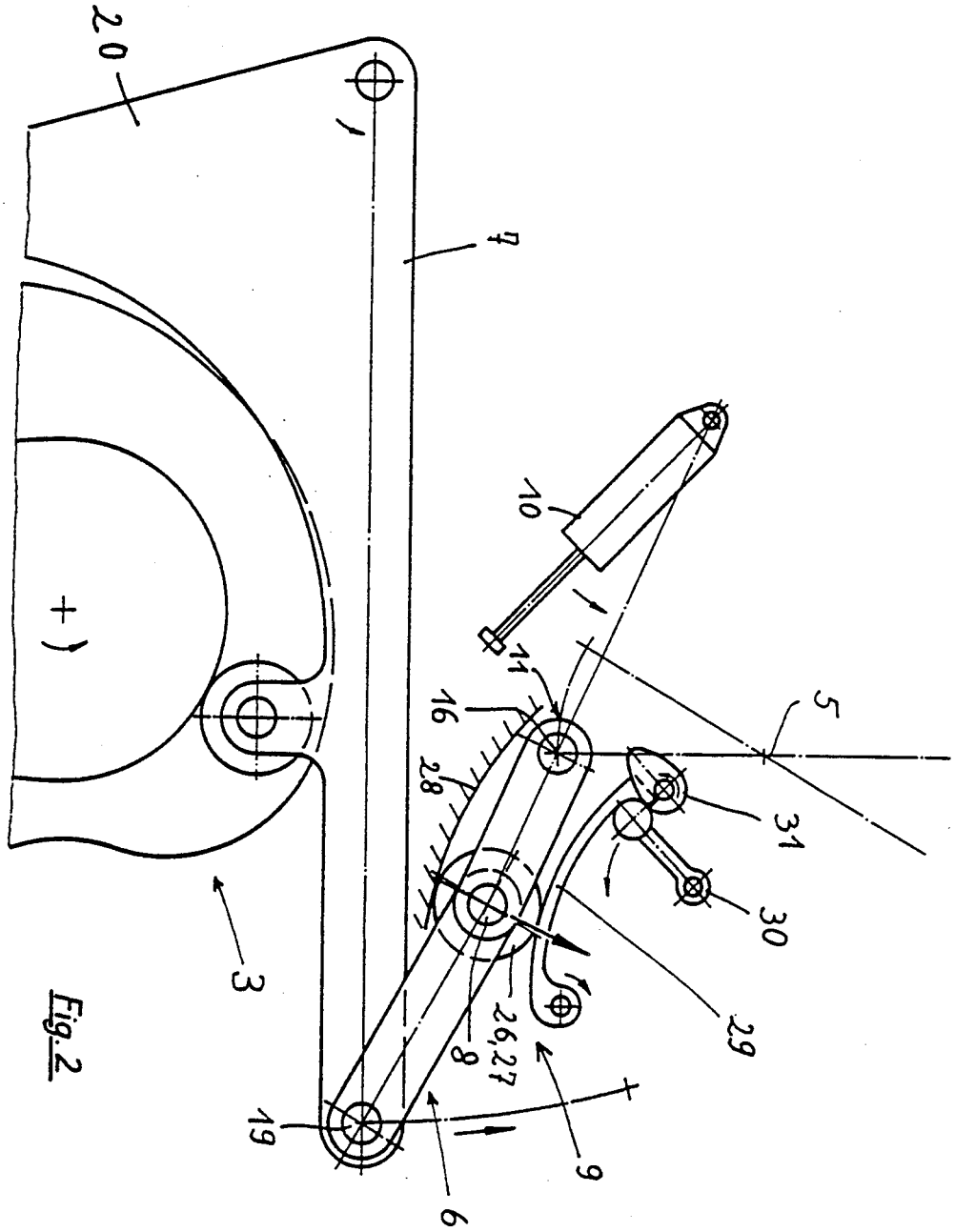
FIG. 2 is a schematic side elevational view similar to FIG. 1 showing a first embodiment of the quick shut-down mechanism.
Figure 4:
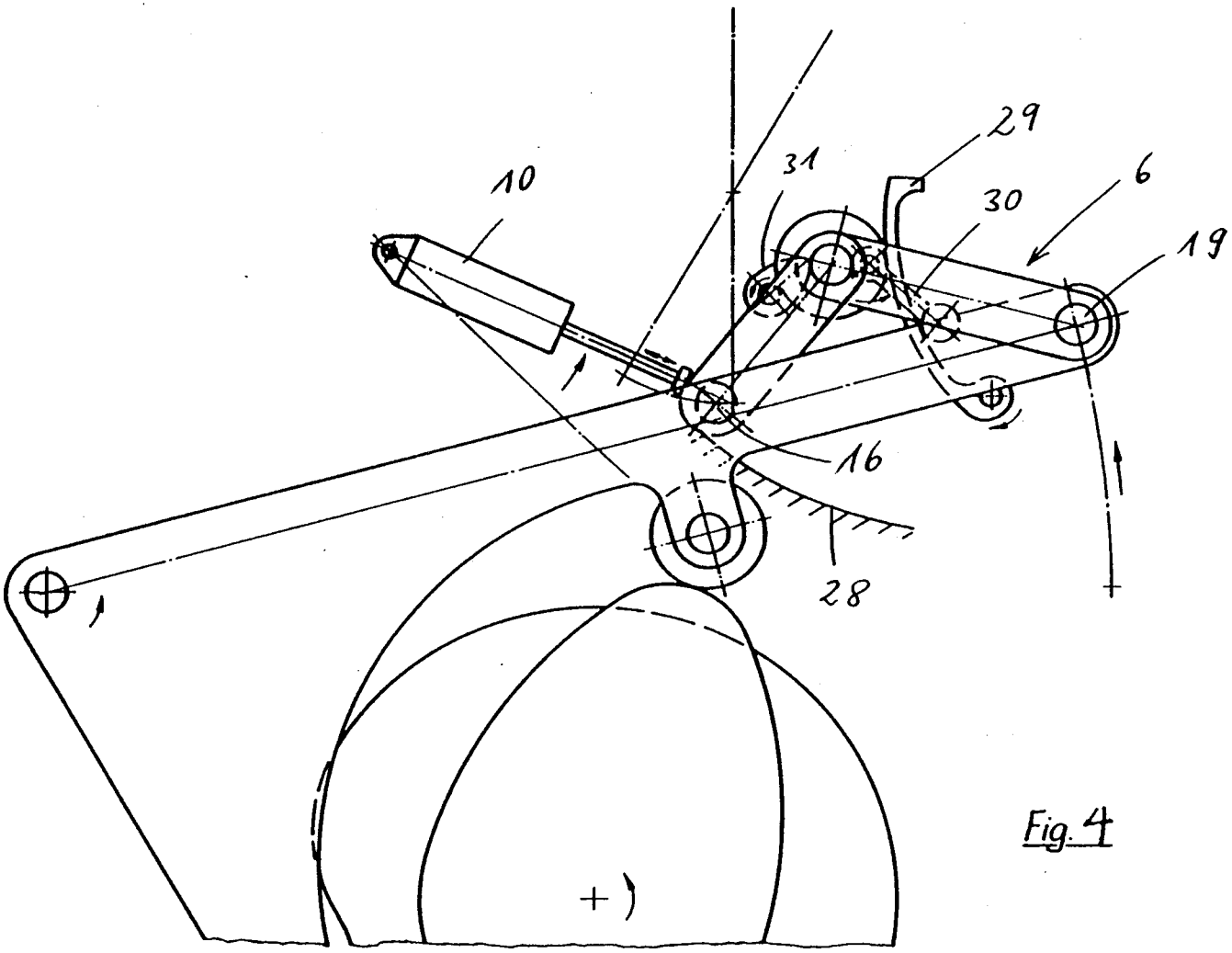
FIG. 4 is a view of the mechanism in FIG. 2 in the shutdown condition.

FIG. 2 shows a first example of a quick shut-down mechanism. It differs from FIG. 1 only with respect to the first arm 6 of the toggle joint 2 so that the other components are not shown at all or not shown completely. The first arm 6 is designed for folding about a pivot pin 8 so that the first arm 6 itself acts as a toggle joint. In normal operation of the power loom the first arm 6 is always in its nearly straight, elongated position. It merely folds upwardly by one or two degrees. In order to prevent the first arm 6 from folding in the course of normal operation, the pivot pin 8 of the first arm 6 is positively guided along a curved cam 9. To this end, two rollers 26, 27 (only one of which is visible) are rotatably supported side by side on the pivot pin 8 and roll along the cam 9 during the normal weaving operation. The cam 9 according to the embodiment shown in FIG. 2 is formed by a lower race 28 and an upper race 29. The lower race 28 is fixed while the upper cam race 29 is mounted for pivotal movement from the position shown in FIG. 2 in the direction of the arrow 29′ away from the race 28. The upper cam race 29 is normally maintained in the position shown in FIG. 2 by means of a link or locking arm 30 disposed substantially perpendicular thereto. The link 30 is mounted for pivotal movement from the position shown in FIG. 2 in the direction of the arrow 30′. A cam 31 is pivotally mounted adjacent the locking arm 30 and the cam 31, the locking arm 30 and the race 29 are normally maintained in the position shown in FIG. 2 during the operation of the loom. Upon pivotal movement of the cam 31 in the direction of the arrow 31′ by any suitable means, the cam 31 will cause the arm 30 to pivot in the direction of the arrow 30′ out of locking engagement with the upper race 29, thereby allowing the upper race 29 to pivot in the direction of the arrow 29′ away from the fixed lower race 28 as shown in FIG. 4.

For a quick shutdown, the shock absorber 10 is pivoted in the direction of the arrow 10′ from the position shown in FIG. 2 in which it is normally maintained during operation of the loom into substantial alignment with the arm 6 when the arm 6 is shown in the position in FIG. 2. During normal operation, the pivot point 16 between the arm 6 and the sley support 1 would normally move along the path 11 shown in FIG. 2. However, when the shock absorber 10 is in substantial alignment with the arm 6, the end of the arm 6 adjacent the pivot point 16 will engage the shock absorber to prevent normal movement of the arm 6 as shown in FIG. 4. Since the upper can race 29 is free for pivotal movement in the direction of the arrow 29′, as described in the previous paragraph, the arm 6 is free to fold upwardly into the position shown in FIG. 4 so that it no longer exerts a force on the sley support 1. Thus, the pivot point 16 will remain at rest upon the initiation of the quick shutdown by pivotal movement of the cam 31 in the direction of the arrow 31′ and the pivotal movement of the shock absorber 10 in the direction of the arrow 10 as described above.

Figure 3:
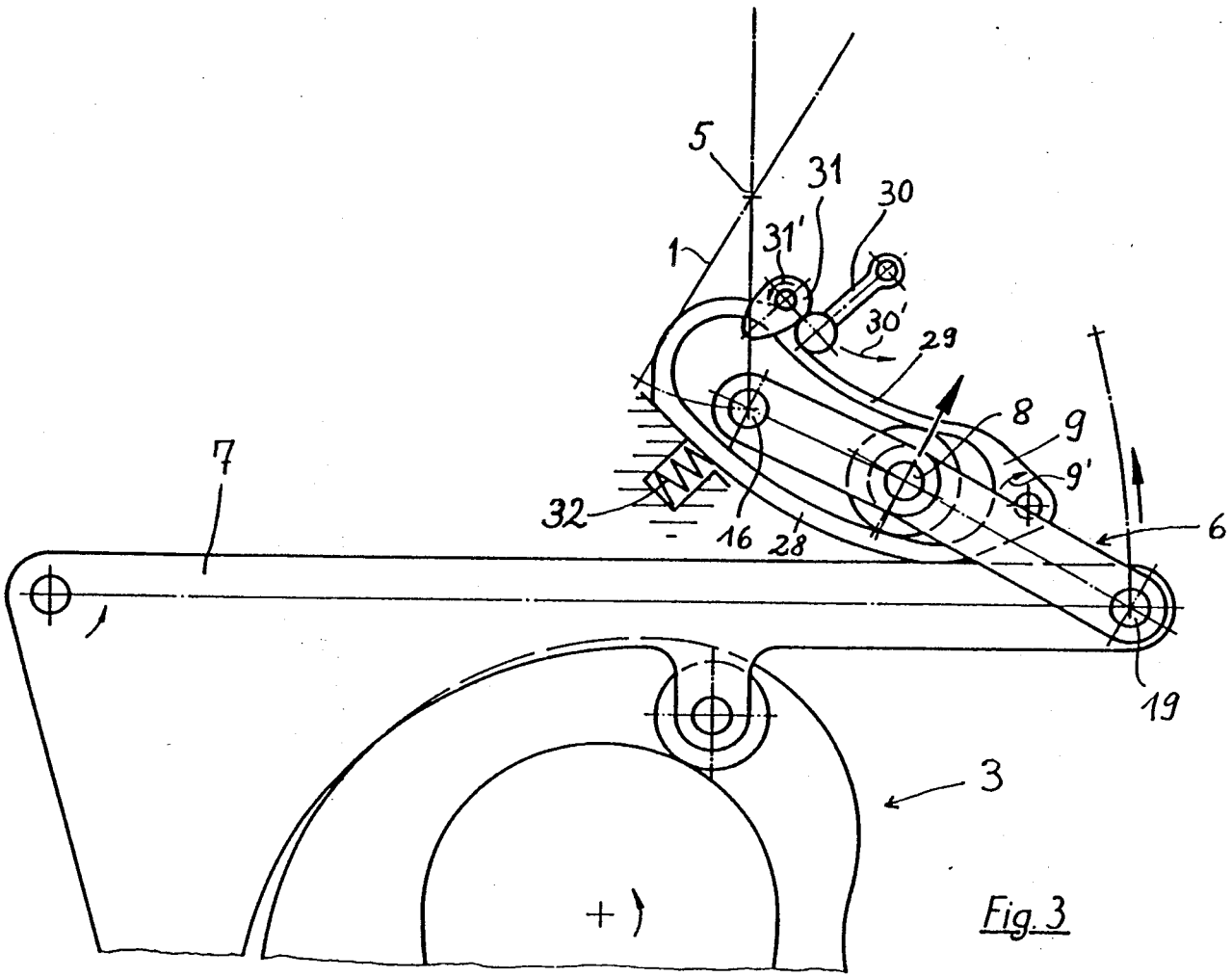
FIG. 3 is a schematic elevational view similar to FIG. 1 showing a second embodiment of the quick shut-down mechanism.

FIG. 3 shows another embodiment of the quick shutdown mechanism. It differs from the example illustrated by FIG. 2 in that the two cam races 28, 29 of the cam 9 are fixedly connected to each other so that upon quick shut-down the entire cam 9 is turned away as a unit. The locking arm 30 normally maintains the cam 9 in the position shown in FIG. 3. As in the previous embodiment, pivotal movement of the cam 31 in the direction of the arrow 31′ to initiate a quick shutdown, will cause the locking arm 30 to pivot in the direction of the arrow 30 thereby releasing the cam 9 so that it will be free for pivotal movement in the direction of the arrow 9′. A shock absorber identical to the shock absorber shown in FIG. 2 will be moved into alignment with the arm 6 in the same manner as described with respect to FIG. 2, upon the initiation of the quick shutdown. Thus, as the arm 6 tends to fold since the pivot point 16 cannot move, the cam 9 will pivot in the direction of the arrow 9′. The pivotal movement of the cam 9 in the direction of the arrow 9′ is enhanced by the compression spring 32.

The complementary cam drive 3 can be replaced by an eccentric drive.

What is claimed is:

1. A sley drive for a power loom comprising a sley having a reed thereon mounted on a sley support pivoted on a loom frame, a toggle joint having a first arm and a second arm, said first arm being approximately one half as long as said second arm, a first pivot connecting said first arm to said second arm at one end of said first arm with the other end of the first arm being pivotally connected to said sley support and a second pivot connecting the second arm to said frame and complementary cam drive means mounted on said frame for engagement with said second arm wherein said second arm extends substantially horizontally above said cam drive means with said first pivot being offset to one side below said sley support and with said second pivot being offset to the other side below said sley support and wherein said first arm is folded back nearly completely relative to said second arm when said reed beats against a fabric and opens to an angle of 30° when the sley moves away from said fabric.

2. A sley drive according to claim 1, wherein said complementary cam drive means and said toggle joint are arranged below said sley support with the toggle joint being pivotally connected to said sley support below the pivot for said sley support.

3. A sley drive according to claim 1, wherein said first arm of said toggle joint is comprised of two parts interconnected by a pivot pin, additional cam means pivotally mounted on said loom frame adjacent said pivot pin, movable locking means normally engaging said additional cam means to maintain said additional cam means in a first position, cam follower means carried by said pivot pin and disposed in contact with said additional cam means whereby when said additional cam means is in said first position said parts of said first arm will be maintained in substantial alignment during operation and means for moving said locking means to allow for pivoting of said additional cam means out of said first position to permit misalignment of said parts of said first arm.

4. A sley drive according to claim 3, further comprising shock absorber means pivotally mounted on said frame for movement into engagement with said first arm where it is pivotally connected to said sley support.

* * * * *